US008181689B2

(12) United States Patent
Gill et al.

(10) Patent No.: US 8,181,689 B2
(45) Date of Patent: May 22, 2012

(54) TELESCOPING GATE SYSTEM AND METHOD

(75) Inventors: Bruce G. Gill, Greenwich, NY (US); Douglas J. Blanchard, Greenwich, NY (US)

(73) Assignee: Tymetal Corp., Greenwich, NY (US)

( * ) Notice: Subject to any disclaimer, the term of this patent is extended or adjusted under 35 U.S.C. 154(b) by 664 days.

(21) Appl. No.: 12/275,215

(22) Filed: Nov. 20, 2008

(65) Prior Publication Data

US 2009/0139144 A1 Jun. 4, 2009

Related U.S. Application Data

(60) Provisional application No. 60/989,360, filed on Nov. 20, 2007.

(51) Int. Cl.
*E05D 15/06* (2006.01)

(52) U.S. Cl. ..... 160/202; 160/214; 160/226; 49/49

(58) Field of Classification Search ..... 160/201, 160/202, 214, 226, 227, 228; 49/49, 125, 49/103, 100, 73.1, 372, 65, 102, 404, 421, 49/425, 427

See application file for complete search history.

(56) References Cited

U.S. PATENT DOCUMENTS 219,261 A * 9/1879 Hickok ..... 49/427
643,307 A * 2/1900 Schmitt ..... 160/197
731,716 A * 6/1903 Slater ..... 49/427
1,917,415 A * 7/1933 Woodruff ..... 49/100
2,466,913 A * 4/1949 Rogers ..... 160/224
2,841,390 A * 7/1958 Urquhart ..... 49/102
4,852,300 A * 8/1989 Keast ..... 49/102
6,052,981 A * 4/2000 Pavone ..... 56/328.1
6,751,907 B1 * 6/2004 De Gasperis ..... 49/404
6,880,610 B1 * 4/2005 Bush ..... 160/202
2009/0139144 A1 * 6/2009 Gill et al. ..... 49/168

* cited by examiner

*Primary Examiner* — Blair M. Johnson

(74) *Attorney, Agent, or Firm* — Kenealy Vaidya LLP

(57) ABSTRACT

A telescoping gate can include a frame, a primary gate member connected to the frame in a manner such that the primary gate member can move relative to the frame, and a secondary gate member that is moveable with respect to both the primary gate member and the frame. The primary gate member can include at least one side wall, a top wall extending at an angle from a top of the side wall, and a bottom wall extending at an angle from a bottom of the side wall to create a cavity between the bottom wall, side wall and top wall. The secondary gate member can be located in the cavity of the primary gate member and configured to move relative to the primary gate member and the frame within that cavity. The bottom wall of the primary gate member includes a first roller/rail structure and the secondary gate member includes a bottom wall having a first roller/rail structure configured to mate with the first roller/rail structure of the primary gate member bottom wall. In addition, the bottom wall of the primary gate can include a roller/rail structure configured to contact a mating ground roller/rail structure.

19 Claims, 7 Drawing Sheets

TELESCOPING GATE SYSTEM AND METHOD

This application claims priority under 35 U.S.C. §119 to U.S. Provisional application No. 60/989,360, filed 20 Nov. 2007, the entirety of which is incorporated by reference herein.

BACKGROUND

1. Field

The presently disclosed subject matter relates to a telescoping gate system and method.

2. Description of the Related Art

Swing gates and sliding gates are generally known to gate a throughway opening. The type of gate employed can be determined by the available space proximate the opening in which the gate can extend when the gate is displaced away from the opening. For extremely large openings in a secured perimeter, such as at an industrial site or an airport, the space available for stowing the gate in an opened position may be substantially smaller than the span of the opening. In the past, if the storage space was smaller than the space available, an overhead lift gate was required to be used. As such, there is a long felt need to provide a sliding type gate that can span an extremely large opening and that can fit into a space substantially smaller than the span of the opening when the gate is in the fully opened position.

SUMMARY

In accordance with an aspect of the disclosed subject matter, a telescoping gate assembly can include a frame, a primary gate member connected to the frame such that the primary gate member is movable relative to the frame, the primary gate member including at least one side wall, a top wall extending at an angle from a top of the side wall, and a bottom wall extending at an angle from a bottom of the side wall to create a cavity between the bottom wall, side wall and top wall. The assembly can also include a secondary gate member located in the cavity of the primary gate member and configured to move relative to the primary gate member and the frame, wherein at least one of the bottom wall and top wall of the primary gate member includes a first roller/rail structure located a first distance from the side wall and a second roller/rail structure located a second distance from the side wall, and the first distance is less than the second distance.

According to another aspect of the disclosed subject matter, a telescoping gate assembly can include a frame, a ground roller/rail structure formed along at least one imaginary line, a primary gate member connected to the frame such that the primary gate member is movable relative to the frame and is located above the ground roller/rail structure, the primary gate member including at least one side wall, a top wall, and a bottom wall forming a cavity therein, at least one primary ground roller/rail structure located at the bottom wall and extending downward and away from the cavity and in operative contact with the ground roller/rail structure at a first location. The assembly can also include a secondary gate member directly connected to the primary gate member such that the secondary gate member is movable relative to the primary gate member and the frame, and the secondary gate member includes at least one secondary ground roller/rail structure in operative contact with the ground roller rail structure at a second location, wherein the first location and second location are each located along the imaginary line.

According to yet another aspect of the disclosed subject matter, a method of operating a telescoping gate assembly to provide vehicular access to and block vehicular access from a particular area, can include providing a frame connected to a ground substrate, a primary gate member connected to the frame in a manner such that the primary gate member can move relative to the frame, a secondary gate member directly connected to the primary gate member in a manner such that the secondary gate member can move relative to the primary gate member and the frame, and a ground roller/rail structure located on the ground substrate, wherein the primary gate member includes a primary lower roller/rail structure which cooperates with the ground roller/rail structure of the ground substrate, and wherein the secondary gate member includes a secondary lower roller/rail structure that cooperates with the ground roller/rail structure to allow the primary gate member to move with respect to the secondary gate member, moving the secondary gate member with respect to the primary gate member from a fully opened position at which the primary gate member and secondary gate member are located on a first side of the frame to a fully closed position at which the secondary gate member extends from the primary gate member and the primary gate member and secondary gate member are located on an opposing side of the frame.

BRIEF DESCRIPTION OF THE DRAWINGS

The disclosed subject matter of the present application will now be described in more detail with reference to exemplary embodiments of the apparatus and method, given by way of example, and with reference to the accompanying drawings, in which.

DETAILED DESCRIPTION OF EXEMPLARY EMBODIMENTS

Figure 1:
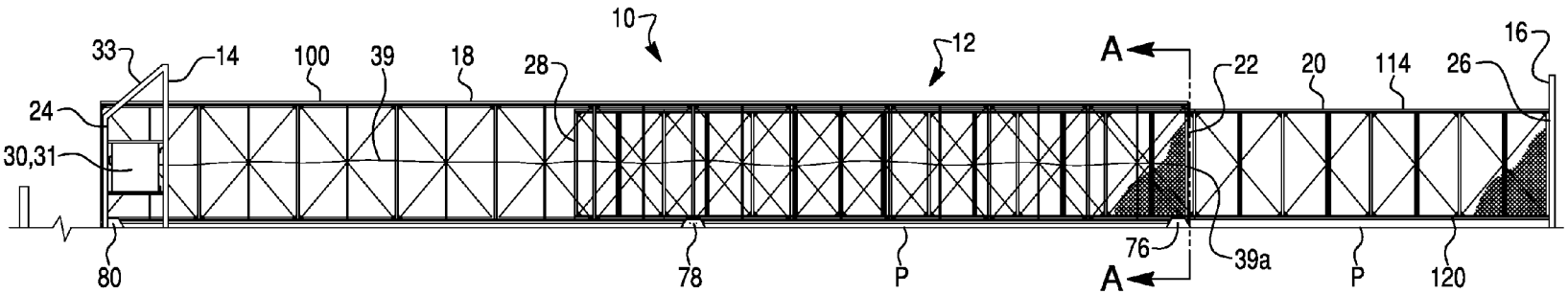
FIG. 1 is a side view of an embodiment of a telescoping gate system with a gate assembly in a closed position in accordance with principles of the disclosed subject matter.
Figure 2:
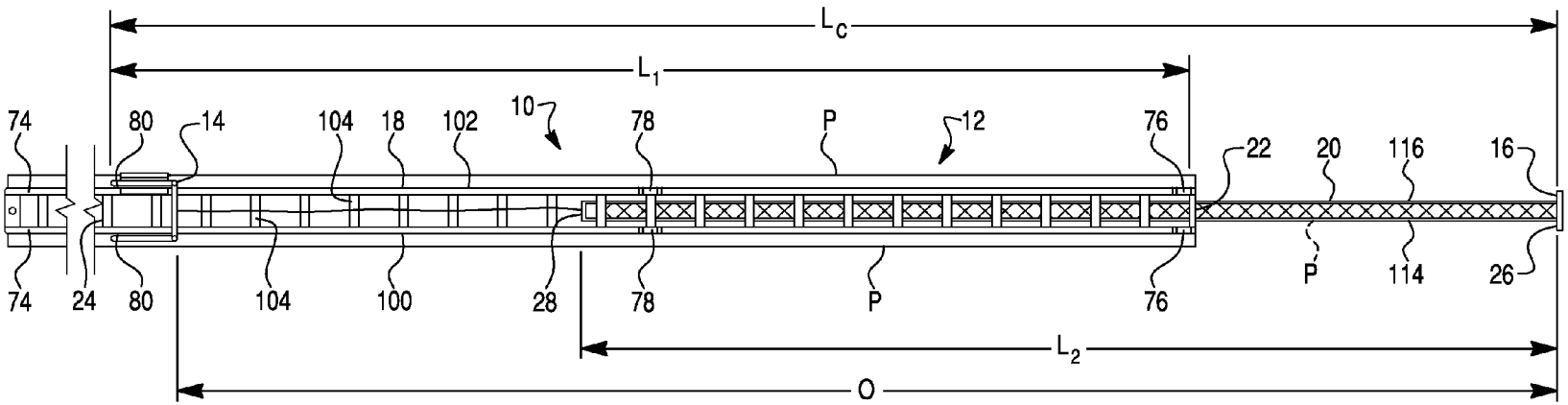
FIG. 2 is a top view of the telescopic gate system of FIG. 1.
Figure 3:
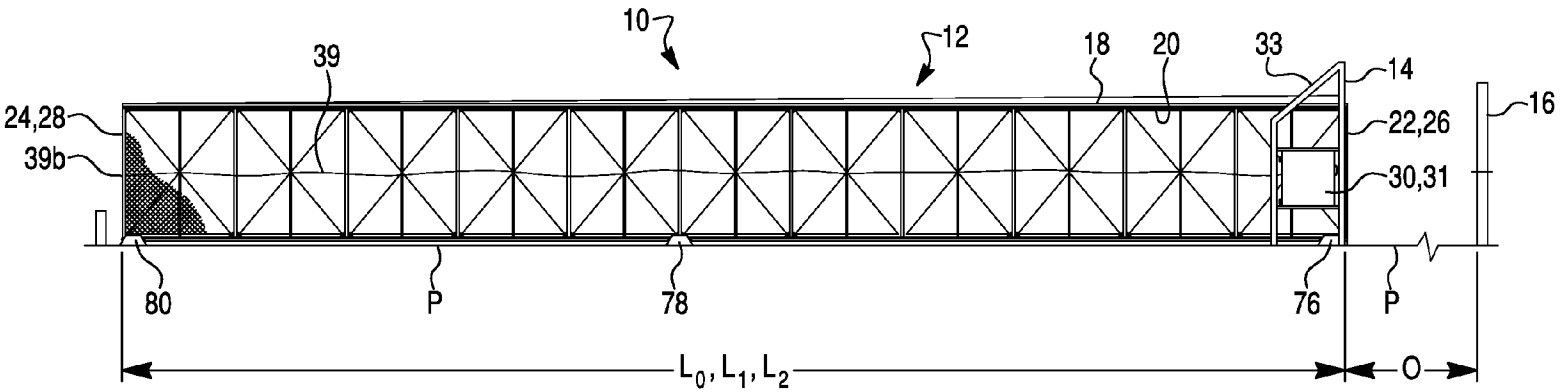
FIG. 3 is a side view of the telescoping gate system of FIG. 1 with the gate assembly in an opened position.

FIGS. 1-3 show an example of a telescoping gate system 10 made in accordance with principles of the disclosed subject matter. The telescopic gate system 10 can include a gate assembly 12 that can obstruct or permit passage through an opening in a securable perimeter, such as, an opening in a perimeter fence, an opening between adjacent buildings, an opening between a fence and a building wall, etc. In the embodiment depicted in FIGS. 1-3, the opening can extend from a near edge 14 to a far edge 16. The gate assembly 12 can move between a closed position (depicted in FIGS. 1 and 2) where the gate assembly 12 completely obstructs passage through the opening and a fully opened position (depicted in FIG. 3) where the gate assembly 12 lies outside the span of the opening and permits passage through the opening. Additionally, the gate assembly 12 can be located at any position intermediate the closed position and the opened position, where a portion of the opening is obstructed by the gate assembly 12 and the remainder of the opening is unobstructed by the gate assembly 12.

The gate assembly 12 can include a first (primary) gate member 18 that can move between a closed position and an opened position, and a second (secondary) gate member 20 that can move relative to the first gate member between a closed position and an opened position. When the gate assembly 12 is in the closed position, the first and second gate members 18, 20 are in their respective closed positions. Similarly, when the gate assembly 12 is in the opened position, the first and second gate members 18, 20 are in their respective opened positions. Additionally, the first and second gate members 18, 20 can each be located at any position intermediate their respective opened and closed positions where the intermediate locations of the first and second gate members 18, 20 correspond to the intermediate location of the gate assembly 12.

When moving between the closed position and the opened position, the gate assembly 12 travels along a path P that extends from the near edge 14 of the opening to the far edge 16 of the opening. The first gate member 18 can travel between its closed position and its opened position along this path P. The first gate member 18 can support the second gate member 20 above the path P when the gate assembly 12 is stationary, as well as when the gate assembly 12 moves between the closed and opened positions. The first gate member 18 also can support the second gate member 20 for movement along the first gate member 18 in a direction parallel to the path P as the second gate member 20 travels between its closed position and its opened position. Thus, the gate member 20 can extend and retract relative to the first gate member 18 in a telescopic manner.

With reference to FIGS. 1 and 2, extension of the second gate member 20 relative to the first gate member 18 can provide an overall length $L_C$ of the gate assembly 12 that is greater than the distance O between the edges 14, 16 of the opening when the gate assembly 12 is in the closed position. And, as depicted in FIG. 3, when the gate assembly 12 is in the opened position, retraction of the second gate member 20 relative to the first gate member 18 can provide an overall length $L_O$ of the gate assembly that is substantially less than distance O between the edges 14, 16 of the opening. Thus, the gate assembly 12 can fit into a space that is substantially less than the distance O of the opening when the gate assembly 12 is in the opened position.

As shown by way of example in FIG. 3, the overall length $L_O$ of the gate assembly 12 in its opened position can also be approximately equal to the length $L_1$ of the first gate member 18. The length $L_2$ of the second gate member 20 can be approximately equal to the length $L_1$ of the first gate member 18. And, the second gate member 20 can retract along the first gate member 18 to lie within the extent of the first gate member 18 such that the overall open length $L_O$ of the gate assembly 12 is approximately equal to the length $L_1$ of the first gate member 18.

For example, in one exemplary embodiment of the gate assembly 12 according to the disclosed subject matter, the first and second gate members 18, 20 each can have a length $L_1$, $L_2$ of approximately 58 feet and the distance O between the opening edges can be approximately 80 feet. In this exemplary embodiment, the overall length $L_O$ of the gate assembly in its opened position can be approximately 58 feet. Thus, the opened length $L_O$ is approximately 75% of the closed length $L_C$.

Further, the length of each of the gate members 18, 20 can be greater than approximately one half of the distance O between the opening edges 14, 16. Conversely, the overall length $L_C$ of the gate assembly 12 when the second gate member is in the closed position can be less than the sum of the lengths $L_1$, $L_2$ of each of the gate members 18, 20. In the above-referenced exemplary embodiment, the overall length $L_C$ of the gate assembly 12 in the closed position can be approximately 84 feet, 10 inches which is greater than the distance O (e.g., 80 feet) between the opening edges 14, 16 and less than the sum (e.g., 116 feet) of the lengths $L_1$, $L_2$ of the first and second gate members 18, 20.

When the gate assembly 12 is in the closed position of FIG. 1, a first end 22 of the first gate member 18 can be intermediate the edges 14, 16 of the opening and a second end 24 of the first gate member 18 can be spaced from the near edge 14 of the opening at a position that is beyond the opening, but in proximity of the near edge 14. Further, a first end 26 of the second gate member 20 can abut the far edge 16 of the opening and a second end 28 of the second gate member 20 can be intermediate the opening edges 14, 16, intermediate the first and second ends 22, 24 of the first gate member 18, and intermediate the first end 22 of the first gate member 18 and the near edge 14 of the opening.

Thus, when the first and second gate members 18, 20 are in their closed positions, a portion of the second gate member 20 can overlap a portion of the first gate section 18. This overlap provides a continuous obstruction of the opening when the gate assembly 12 is in the closed position.

In the above-reference exemplary embodiment, the second gate member 20 has a portion spanning approximately 31 feet, 2 inches that overlaps a portion of the first gate member 18 that spans approximately 31 feet, 2 inches. This overlap can be built into the design of the gate for structural stability. Of course, other features could also be provided to provide this structural stability, such as rollers located under each of the gate members 18 and 20 at various locations, or increased strength of materials that make up the gate members 18 and 20.

In the opened position of the embodiment depicted in FIG. 3, the first ends 22, 26 of the first and second gate members 18, 20 are adjacent one another and adjacent the near edge 14 of the opening. The second ends 24, 28 of the first and second gate members 18, 20 are adjacent one another and spaced from the near edge 14 of the opening at a position that is outside of the opening.

In operation, the first end 26 of the second gate member 20 can be located beyond the first end 22 and therefore outside of the first gate member 22 when the first and second members 18, 20 are in the opened position. This staggered alignment of the second gate member 20 relative to the first gate member 18 can provide packaging space for a mechanism for displacing the second gate member 20 relative to the first gate member 18 (e.g., a motor). Details of an example of a displacement mechanism will be described in detail below.

In comparing FIGS. 1 and 3, the second gate member 20 can travel a greater distance between its closed and opened positions as compared to the distance O that the first gate member 18 travels between its closed and opened positions, where both distances are measured relative to the path P. The first end 26 of the second gate member 20 can travel a distance approximately equal to the distance between the opening edges 14, 16 when the gate assembly 12 moves between the closed position and the opened position. However, the first end 22 of the first gate member 18 travels a distance that is less than the distance between the opening edges 14, 16. The distance traveled by the first end 22 of the first gate member 18 can be less than the length $L_1$ of the first gate member 18.

In the above-referenced exemplary embodiment, the first end 26 of the second gate member 20 can travel a distance of approximately 80 feet and the first end 22 of the first gate member 18 can travel a distance of approximately 53 feet, 2 inches as measured along the path P. Thus, the distance between the closed and opened positions of the second gate member 20 can be substantially greater than the distance between the closed and opened positions of the first gate member 18.

The first and second gate members 18, 20 can move sequentially as the gate assembly 12 moves between the closed position and the opened position. That is, one of the first and second gate members 18, 20 can be moved to the desired location between its closed position and its opened position. Then, the other of the first and second gate members 18, 20 can be moved to the desired location between its closed position and its opened position. Thus, the total time to move the gate assembly 12 will be equal to the time needed to move first gate member 18 plus the time needed to move the second gate assembly 18.

Alternatively, the first and second gate members 18, 20 can move relative to one another simultaneously between their respective closed positions and opened positions. Simultaneous displacement of the first and second gate members 18, 20 can minimize the amount of time required to move the gate assembly 12 between the opened and closed position. That is, the total time needed to move the gate assembly 12 will be equal to the greater of the time needed to move the first member 18 and the time needed to move the second member 20.

The first and second gate members 18, 20 can be linked together such that movement of the first gate member 18 can cause movement of the second gate member 20 relative to the first gate member 18. Thus, the second gate member 20 can be displaced relative to the first gate member 18 simultaneous to the displacement of the first gate member 18.

In an embodiment according to the disclosed subject matter, the first gate member 18 can be displaced along the path P by a conventional motorized operator assembly 30, such as that manufactured by Tymetal Corporation and marketed as 225VS Gate Operator. A cable and pulley assembly 32, 34 can displace the second gate member 20 relative to the first gate member 18 as the conventional operator assembly 30 displaces the first gate member 18 along the path P. Thus, the cable and pulley assembly 32, 34 can simultaneously move the second gate member 20 between its closed and opened positions as the conventional operator assembly 30 moves the first gate member 18 between its closed and opened positions, respectively.

Figure 4:
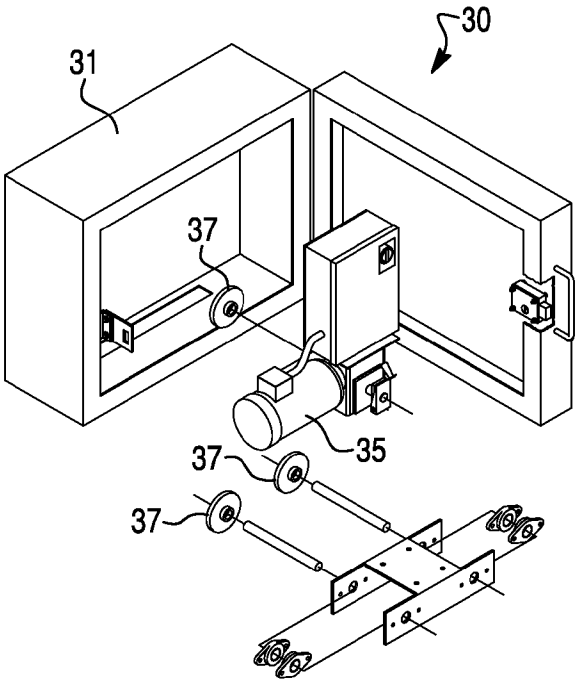
FIG. 4 is an exploded view of a motorized operator in accordance with principles of the disclosed subject matter.

With reference to FIGS. 1, 3 and 4, the motorized operator 30 can include a housing 31 supported on a frame 33. The frame 33 can be secured to the ground adjacent the near edge 14 of the opening. More particularly, the frame 33 can be secured to a ground substrate 290 such as cement, asphalt, tarmac material, gravel, soil, clay or other known surface on which pedestrians and vehicles can traverse. As shown in FIG. 4, the motorized operator 30 can include an electric motor 35 coupled to a plurality of sprockets 37. The motorized operator 30 can also include a drive chain 39 (FIGS. 1 and 3) that can have a first end 39*a* (FIG. 3) secured to the first gate member first end 22 and a second end 39*b* (FIG. 1) secured to the first gate member 18 second end 24. A portion of the drive chain 39 can pass through the housing 31 to engage the plurality of sprockets 37 to move the first gate member 18 between its closed and opened positions.

The first gate member 18 can be displaced by other systems, such as a hydraulic piston, a pneumatic piston, a rack and pinion drive, a belt and pulley system, or a motorized wheel assembly. Alternatively, the gate assembly can be displaced by manually pushing or pulling the first gate member 18 to the desired position between its closed and opened positions, or by operating a linkage or other mechanical non-powered apparatus for moving a gate.

The chain and sprocket of the operator assembly 30 can move the first and second gate members 18, 20 along the path P a predetermined distance $D_1$ because the first gate member 18 supports the second gate member 20. Further, the cable and pulley system 32, 34 can move the second gate member 20 relative to the first gate member 18 by a distance $D_2$ when the first gate member 18 moves along the path P. Thus, the second gate member 20 can move parallel to the path P by a distance $D_T$ equal to the distance $D_1$ the first gate member moves along the path P plus the distance $D_2$ the second gate member moves relative to the first gate member 18. Comparing FIGS. 1 and 3, the distance $D_2$ the second gate member 20 moves relative to the first gate member 18 is approximately equal to one-half of the distance $D_1$ the first gate member 18 moves along the path P when the first and second gate members 18, 20 move from their opened positions to their closed positions.

Figure 5:
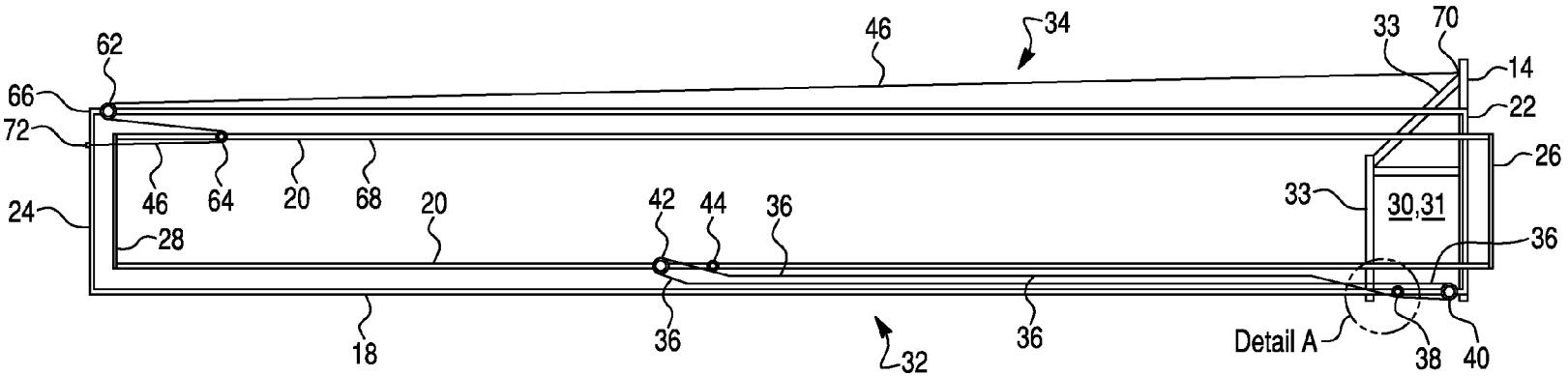
FIG. 5 is a schematic representation of a cable and pulley assembly that can extend and retract a telescoping portion of the telescoping gate system of FIG. 1.

Referring to FIG. 5, the cable and pulley assembly 32, 34 can include an extension assembly 32 and a retraction assembly 34. The extension assembly 32 can displace the second gate member 20 relative to the first gate member 18 in a direction from its opened position toward its closed position. The retraction assembly 34 can displace the second gate member 20 relative to the first gate member 18 in a direction from its closed position toward its opened position.

In this embodiment, the extension assembly 32 includes an extension cable 36 and a plurality of extension pulleys 38, 40, 42, 44 that can support and guide the extension cable 36 as the gate assembly 12 moves between its closed and opened positions. The retraction assembly 34 includes a retraction cable 46 and a plurality of retraction pulleys 62, 64 that can support and guide the retraction cable 46 as the gate assembly 12 moves between its closed and opened positions. The lengths of the extension cable 36 and the retraction cable 46 can be dimensioned so that each cable 36, 46 remains under tension at any position of the gate assembly 12 and during movement of the gate assembly 12.

Figure 6:
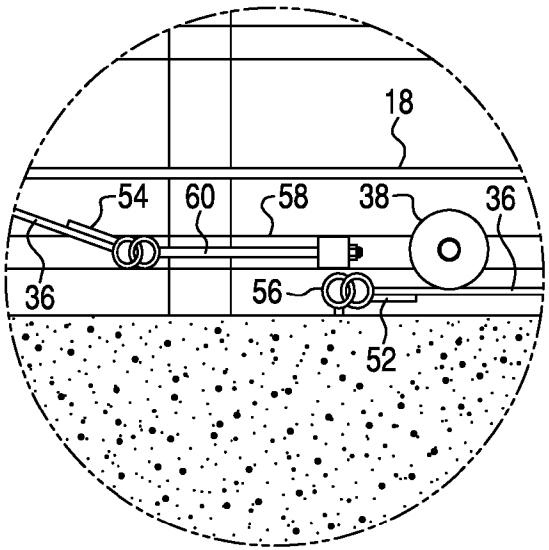
FIG. 6 is an enlarged view of a portion of the cable and pulley assembly of FIG. 5.

A first set of the extension pulleys 38, 40 can be mounted for rotation on the first gate member 18 and a second set of the extension pulleys 42, 44 can be mounted for rotation on the second gate member 20. Referring to FIGS. 5 and 6, the extension cable 36 can thread through the first set of extension pulleys 38, 40 and the second set of extension pulleys 42, 44 in an open loop with one end 52 of the extension cable 36 anchored to the ground and the other end 54 of the extension cable 36 connected to the first gate member 18.

Referring to FIG. 6, the first end 52 can be anchored to the ground by a first eyebolt assembly 56. The first eyebolt assembly 56 can be secured to the ground adjacent the near edge 14 of the opening at a position outside of the opening. The second end 54 of the extension cable 36 can be connected to the bottom 58 of the first gate member 18 near the first gate member first end 22 by a second eyebolt assembly 60 secured to the first gate member bottom 58. The eyebolt assemblies 56, 60 can include a threaded coupling to provide tension adjustment for the extension cable and pulley assembly 32.

The extension cable 36 can extend from the first eyebolt assembly 56, along the first idler pulley 38, around the first reversing pulley 40, around the second reversing pulley 42, along the second idler pulley 44, and to the second eyebolt assembly 60. The first set of extension pulleys 38, 40 can guide the extension cable 36 around the first gate member bottom 58 so that the extension cable 36 cannot interfere with the movement of the first gate member 18 as the first gate member 18 moves between its closed and opened positions.

The second set of extension pulleys 42, 44 can guide the extension cable 36 through the second gate member 20 and can cooperate with the first idler pulley 38 to guide the extension cable between the first gate member 18 and the second gate member 20 so that the extension cable 36 cannot interfere with the movement of the second gate member 20.

The retraction assembly 34 can include the retraction cable 46 and a plurality of retraction pulleys 62, 64 that support and guide the retraction cable 46 as the gate assembly 12 moves between its closed and opened positions. A first one of the retraction pulleys 62 can be mounted for rotation on or near the upper rear corner 66 of the first gate member 18. A second one of the retraction pulleys 64 can be mounted for rotation on the top 68 of the second gate member 20 at a position spaced inwardly of the second gate member second end 28.

Referring to FIG. 5, the retraction cable 46 can thread through the first extension pulley 62 and the second extension pulley 64 with a first end 70 of the retraction cable 46 anchored to the frame 33 and a second end 72 of the retraction cable 46 connected to the first gate member second end 24.

The cable ends 70, 72 can be anchored to the frame 33 and the first member second end 24 via eyebolt assemblies (not shown) in the same manner as the ends 52, 54 of the extension cable 36, as described above, and can include tension adjustment mechanisms to ensure adequate tension in the cable 46.

Thus, the extension assembly 32 and the retraction assembly 34 can be configured to cause the second gate member 20 to move relative to the first gate member by a distance that is approximately equal to one-half the distance the first gate member 18 moves along the path P. Alternatively, the extension and retraction assemblies can be modified to provide other desired displacement ratios depending on the particular application and design parameters.

The first gate member 18 can be supported by and continuously engage the ground surface as the first gate member 18 moves between its closed position and its opened position along the path P. The first gate member 18 can support the second gate member 20 in a cantilevered manner as the second gate member 20 moves between its closed position and its opened position. That is, the first end 26 of the second gate member 20 can be suspended above the ground surface and the first gate member 18 can engage a portion of the second gate member 20 between the first and second ends 26, 28 of the second gate member 20 as the second gate member 20 moves between its closed position and its opened position.

Figure 7:
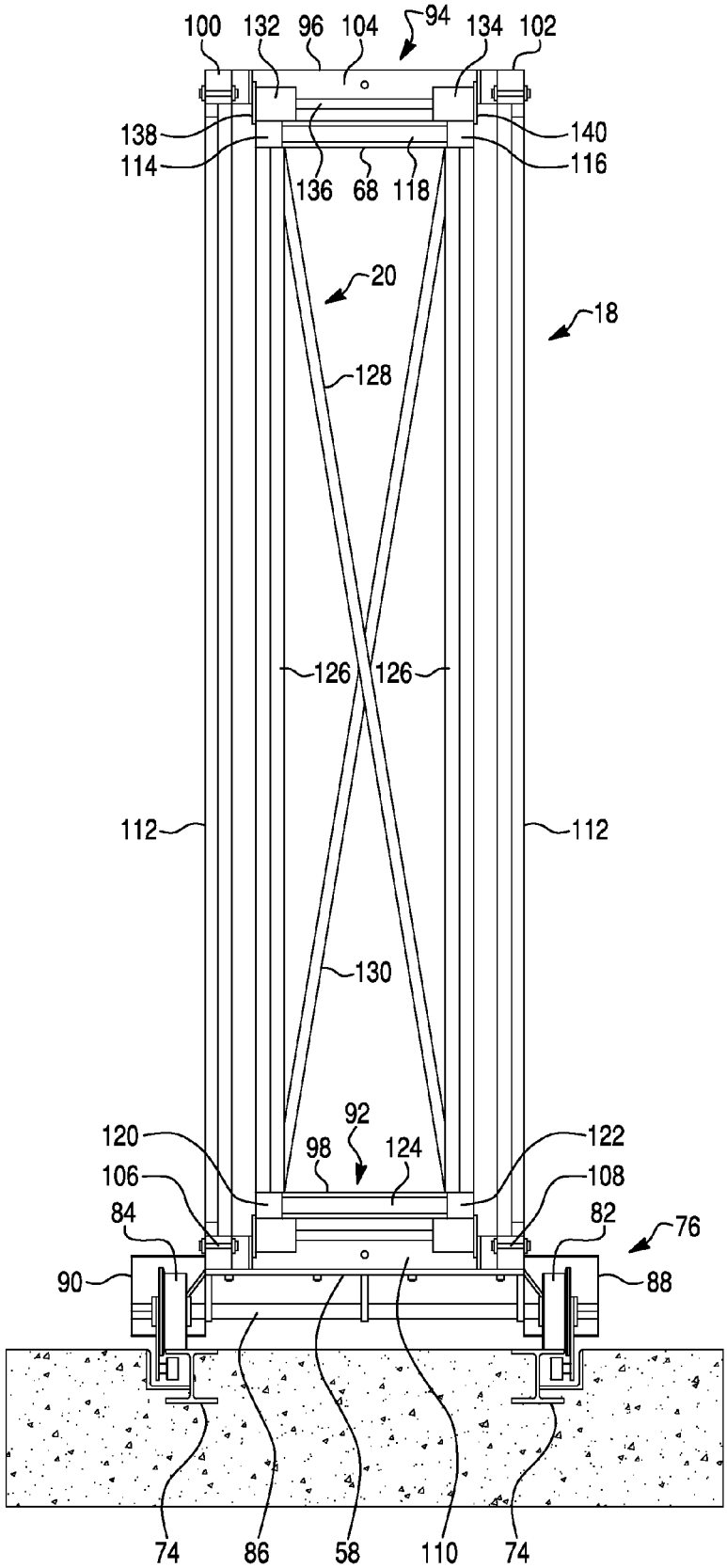
FIG. 7 is a cross-sectional view taken along line A-A in FIG. 1 and shows details of a guide assembly of the telescoping gate system of FIG. 1.

With reference to FIGS. 2 and 7, a pair of rails 74 can be provided on the ground surface to guide the first gate member 18 as it moves between its closed and opened positions. As shown in FIG. 2, the rails 74 can extend along the path P from the near edge 14 of the opening to a position intermediate the near edge 14 and the far edge 16 of the opening.

Referring to FIGS. 1-3 the first gate member 18 can include a plurality of wheel or roller assemblies 76, 78, 80 that can engage the rails 74 to guide the first gate member 18 along the path P. Each of the wheel assemblies 76, 78, 80 can be identical in structure and details of only one of these wheel assemblies 76, 78, 80 will be described with reference to FIG. 7. The wheel assembly 76 can include a pair of flanged wheels 82, 84 coupled to an axle 86. The axle 86 can be rotationally supported on the bottom 58 of the first gate member 18. Each flanged wheel 82, 84 can be enclosed by a respective cover 88, 90. For convenience, a roller/rail structure is used to refer to either one of a roller assembly 76 or a rail 74.

The first and second gate members 18, 20 can each have an elongate box frame structure, as illustrated in FIGS. 1, 2 and 7. The box frame structure of the first and second gate members 18, 20 can be dimensioned to permit the first gate member 18 to receive the second gate member 20 within the box frame structure of the first gate member 18 in a telescopic manner.

The first gate member 18 can support the second gate member 20 for relative movement within its box frame structure on a plurality of roller assemblies that can be spaced along the interior length of the first gate member 18. FIG. 7 illustrates a bottom roller/rail structure 92 rotationally mounted at the bottom 58 of the first gate member 18 and a top roller/rail structure 94 rotationally mounted at the top 96 of the first gate member 18. The first gate member 18 can include a bottom roller/rail structure 92 adjacent each wheel assembly 76, 78, 80 and a top roller/rail structure 94 opposite each bottom roller/rail structure 92. The top roller/rail structures 94 can rotationally engage the top 68 of the second gate member 20 and the bottom roller/rail structures 92 can rotationally engage the bottom 98 of the second gate member 20 as the second gate member 20 moves relative to the first gate member 18.

The first gate member 18 can include a pair of upper horizontally extending rails 100, 102 and a plurality of upper cross rails 104 connecting the upper horizontal rails 100, 102 to define the first gate member top 96. The first gate member 18 can also include a pair of horizontally extending lower rails 106, 108 connected by a plurality of lower cross rails 110 to define the first gate member bottom 58. The first gate member 18 can also include a plurality of vertically extending rails 112 connecting upper rail 100, 102 to the lower rail 106, 108 of the respective side of the first gate member 18. The rails 100, 102, 104, 106, 108, 110, 112 can cooperate with one another to define the elongate box frame structure of the first gate member 18.

The second gate member 20 can include a pair of upper horizontally extending rails 114, 116 and a plurality of upper cross rails 118 connecting the upper horizontal rails 114, 116 to define the second gate member top 68. The second gate member 20 can also include a pair of horizontally extending lower rails 120, 122 connected by a plurality of lower cross rails 124 to define the second gate member bottom 98. The second gate member 20 can also include a plurality of vertically extending rails 126 connecting the upper rail 114, 116 to the lower rails 120, 122 of the respective side of the second gate member 20. A plurality of x-brace members 128, 130 can connect the lower rails 120, 122 to a respective diagonally opposed upper rail 114, 116. The rails 114, 116, 118, 120, 122, 124, 126 and x-brace members 128, 130 can cooperate with one another to define the elongate box frame structure of the second gate member 20.

Each roller/rail structure 92, 94 can be identical in structure and only the details of the top roller/rail structure illustrated in FIG. 7 will be described. In the embodiment shown, the top roller/rail structure 94 includes a pair of rollers 132, 134 coupled to an axle 136. The axle 136 can be mounted for rotation on the top 96 of the first gate member 18. Each roller 132, 134 can include a flange 138, 140 that engages an outer side surface of the second gate member top 68.

Figure 8:
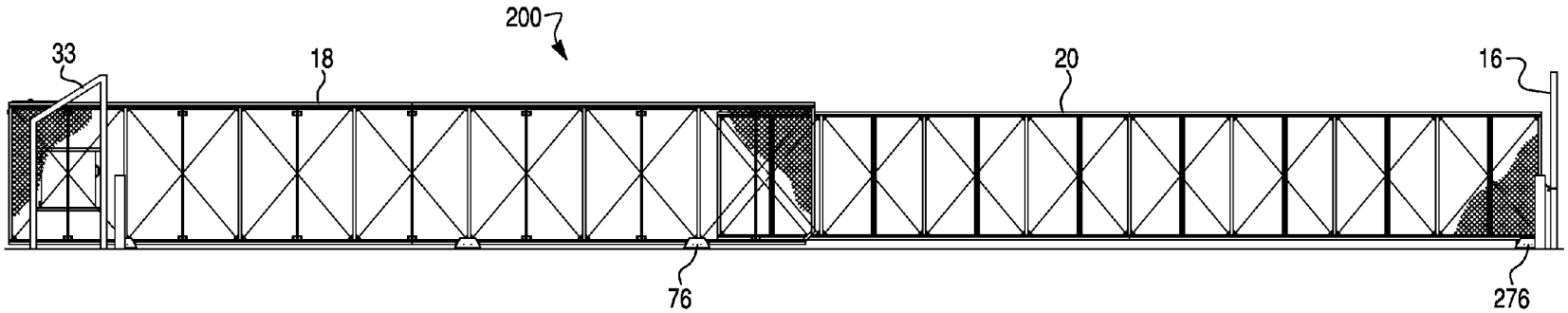
FIG. 8 is a side view of another embodiment of a telescoping gate system with a gate assembly in a closed position in accordance with principles of the disclosed subject matter.

FIG. 8 is a side view of another embodiment of a telescoping gate system 200 made in accordance with principles of the disclosed subject matter and with a gate assembly in a closed position. The gate assembly includes a first gate member 18 and a second gate member, each extending from and movable with respect to each other and a frame 33. In this embodiment, the first gate member 18 has wheel assemblies, for example wheel assembly 76. The second gate member 20 also has at least one roller/rail structure that includes a wheel assembly 276 configured to ride within or on the same track or rail 274 on/in which the wheel assemblies of the first gate member 18 ride.

Figure 9:
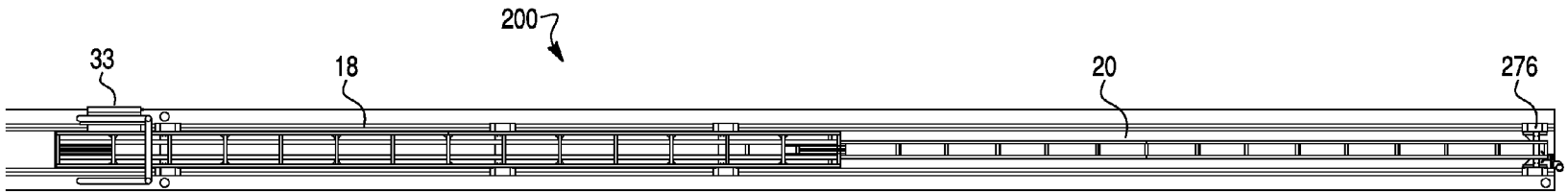
FIG. 9 is a top view of the telescopic gate system of FIG. 8.

FIG. 9 is a top view of the telescopic gate system of FIG. 8 and more clearly shows each of the roller/rail structures of the first and second gate members 18, 20. For example, the first gate member 18 can include three separate roller/rail structures located along the longitudinal length of the first gate member 18. Each of the roller/rail structures can include left and right wheels spaced a first predetermined distance from each other. The second gate member 20 can include at least one roller/rail structure at a distal end that includes left and right wheels spaced the same first predetermined distance from each other.

Figure 10:
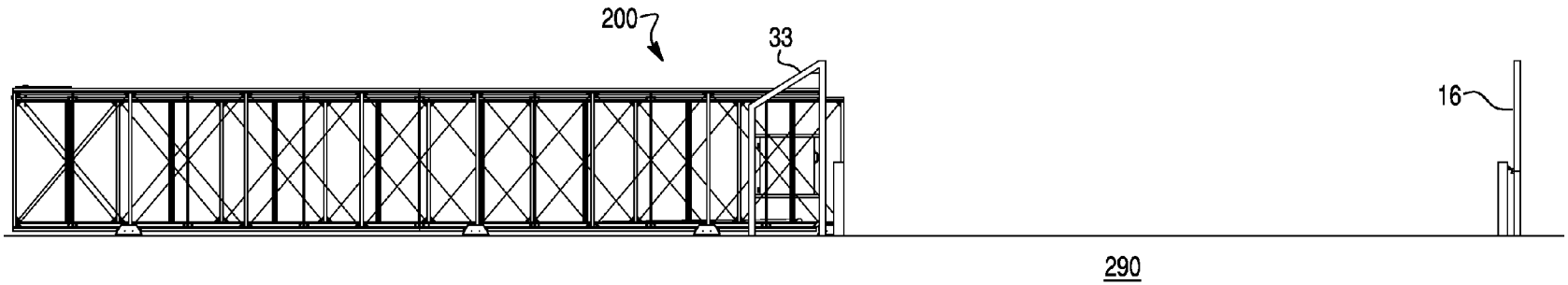
FIG. 10 is a side view of the telescoping gate system of FIG. 8 with the gate assembly in an opened position.
Figure 11:
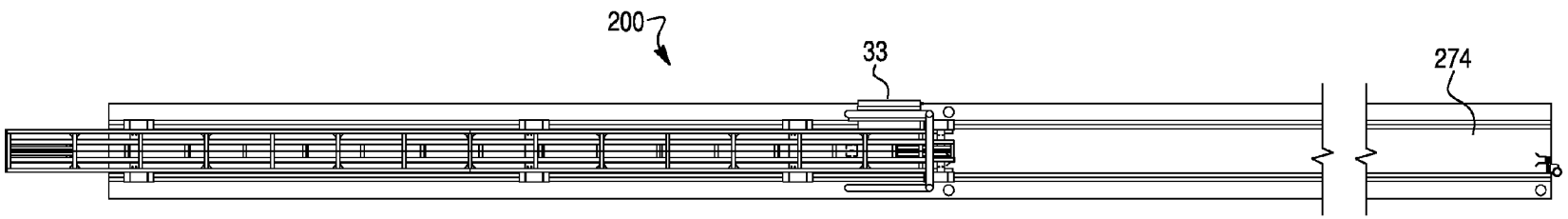
FIG. 11 is a top view of the telescopic gate system of FIG. 8 with the gate assembly in an opened position.

FIGS. 10 and 11 are a side view and top view, respectively, of the telescoping gate system of FIG. 8 with the gate assembly in an opened position. A single pair of rails 274 can be provided upon which the roller assemblies of both the first gate member 18 and second gate member 20 can ride in or on.

Figure 12:
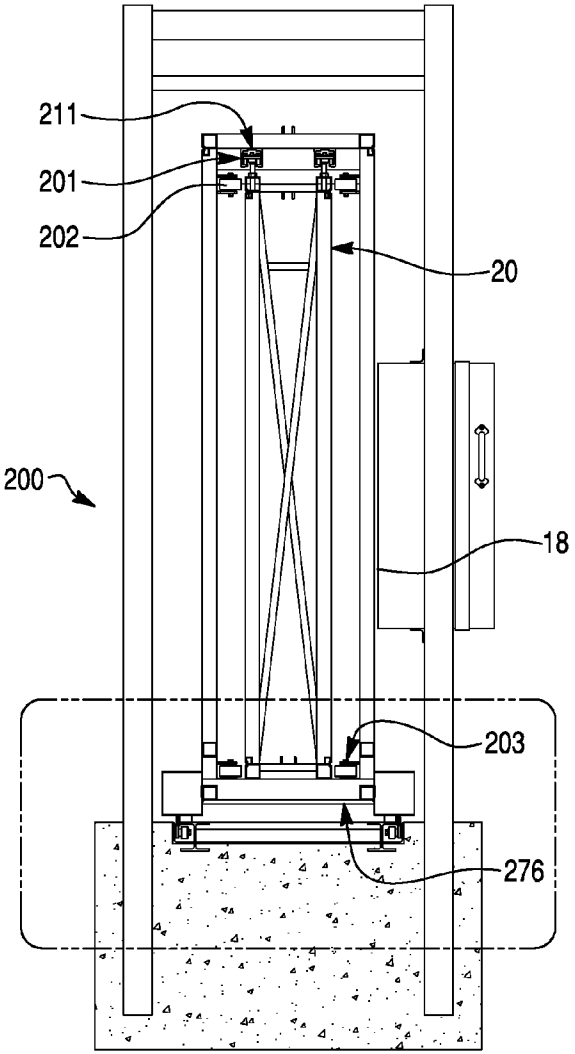
FIG. 12 is an end view of the telescopic gate system of FIG. 8 showing details of a guide assembly.

FIG. 12 is an end view of the telescopic gate system of FIG. 8 showing details of a guide assembly. In this embodiment, the first gate member 18 includes an upper guide roller assembly 202 and a lower guide roller assembly that assist the alignment and relative movement between the first gate member 18 and second gate member 20. In addition, a roller/rail structure can be provided in the form of an overhead track 201 located on the second gate member 20 and configured to mate with trucks 211 that extend from the first gate member 18. The trucks 211 and track 201 can be configured to suspend a portion of the second gate member 20 within the first gate member 18 in a rolling fashion, and to further align the first and second gate members 18 and 20 during relative movement.

Figure 13:
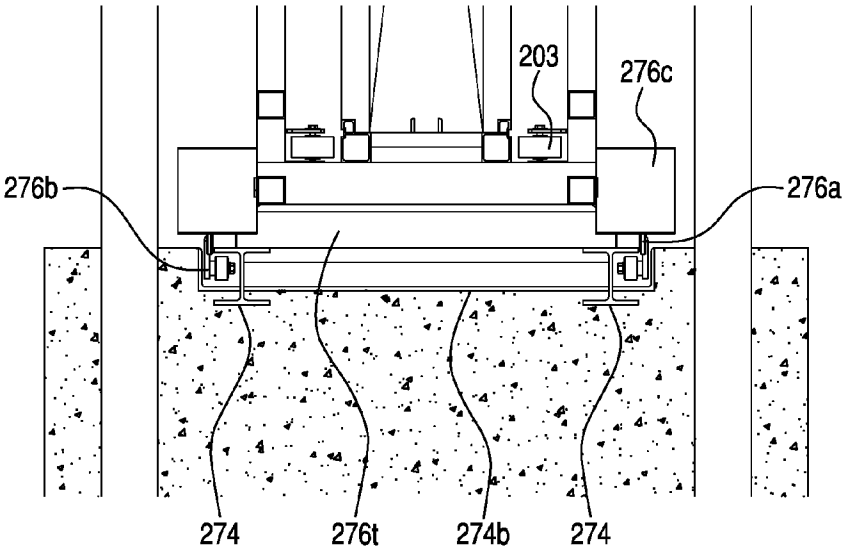
FIG. 13 is a detail view of the area circled in dashed line of FIG. 12.

FIG. 13 is a detail view of the area circled in dashed line of FIG. 12 and shows the roller assembly 276 as including left and right wheels **276*a* that are spaced by a trolley structure 276*t* a predetermined distance apart corresponding to the spacing distance for the rails 274. The roller assembly 276 can also include a wheel cover 276*c* and a safety clip 276*b* that prevents the wheels 276*a* from jumping from the tracks 274. A cross brace 274*b* can be used to consistently space the rails 274** from each other at the predetermined distance.

A cable and pulley system can be driven by a motor located on the frame 33 of the gate system 200 to cause the first and second gate members 18 and 20 to move between the fully opened position as shown in FIG. 10 and the fully closed position shown in FIG. 8. The longitudinal space requirement of the gate system 200 in the fully opened position is reduced in view of the ability of the second gate member 20 to not only support itself with the wheel assembly 276, which requires less cantilevered support, but also in view of the ability of the second gate member 20 to fully retract within the first gate member 18.

While certain embodiments of the disclosed subject matter are described above, it should be understood that the disclosed subject matter can be embodied and configured in many different ways without departing from the spirit and scope of the invention. For example, more than two gate members may be telescopically arranged. The gate members can be suspended from tracks instead of supported on rails and rollers. The gate members can be supported in a cantilever fashion or both gate members can be supported by flanged wheels on a common pair of rails. In another alternative embodiment according to the disclosed subject matter, the gate members can have a planar structure, as compared to the box structure of the gate members described above, where gate members can include a single upper rail, a single lower rail, and a plurality of vertical rails connecting the upper rail to the lower rail. Any of the components of the shown roller/rail structures can be reversed. Moreover, the rail(s) can be replaced with roller(s) and the corresponding roller(s) can be replaced with rail(s).

In addition, there are various alternate cable and pulley assembly configurations that could be provided as well as altogether different movement actuation systems. For example, additional pulleys could be incorporated to diminish the load required on the motor. In addition, supplemental idler gears could be used to ensure consistent operation of the cable pulley system.

While the subject matter has been described in detail with reference to exemplary embodiments thereof, it will be apparent to one skilled in the art that various changes can be made, and equivalents employed, without departing from the scope of the invention. All related art references discussed in the above Description of the Related Art section above are hereby incorporated by reference in their entirety.

What is claimed is:

1. A telescoping gate assembly comprising:

a frame;

a primary gate member connected to the frame such that the primary gate member is movable relative to the frame, the primary gate member including at least one side wall, a top wall extending at an angle from a top of the side wall, and a bottom wall extending at an angle from a bottom of the side wall to create a cavity between the bottom wall, side wall and top wall;

a secondary gate member located in the cavity of the primary gate member and configured to move relative to the primary gate member and the frame, wherein at least one of the bottom wall and top wall of the primary gate member includes a first roller/rail structure located a first distance from the side wall and a second roller/rail structure located a second distance from the side wall, and the first distance is less than the second distance, and the secondary gate member includes a secondary roller structure spaced from the primary gate member and from the first roller/rail structure and second roller/rail structure, the secondary roller structure of the secondary gate member configured to roll on a rail located on a ground substrate located under the telescoping gate assembly;

a retraction cable connected to the primary gate member via a first pulley and connected to the secondary gate member via a second pulley;

an extension cable connected to the primary gate member and secondary gate member; and an actuator assembly connected to the frame, and connected to at least one of the primary gate member and the secondary gate member, and configured to move the at least one of the primary gate member and the secondary gate member relative to the frame.

2. The telescoping gate assembly of claim 1, wherein the actuator assembly includes:

a drive cable connected to at least one of the primary gate member and secondary gate member; and a motor connected to the frame and configured to move the drive cable relative to the frame.

3. The telescoping gate assembly of claim 2, wherein one end of the extension cable is connected to the primary gate member and is configured to move with the primary gate member, and an opposite end of the extension cable is anchored to one of the frame member and a ground such that when the primary gate member moves relative to the frame the primary gate member also moves relative to the opposite end of the of the extension cable.

4. The telescoping gate assembly of claim 1, wherein the primary gate member and secondary gate member are configured to move from a first totally opened position to a second totally closed position, and wherein the secondary gate member is substantially enveloped within the cavity in the primary gate member and the primary gate member and secondary gate member are located on a first side of the frame when in the first totally opened position, and the secondary gate member extends from the cavity of the primary gate member and the primary gate member and the entire secondary gate member are located on a second side of the frame completely opposed to the first side of the frame when in the second totally closed position.

5. The telescoping gate assembly of claim 1, wherein the primary gate member includes a second roller structure configured to roll on the rail on the ground substrate located under the telescoping gate assembly.

6. The telescoping gate assembly of claim 5, wherein the second roller structure of the primary gate member is located within a first plane that is perpendicular to a rotational axis of the first roller/rail structure, and the secondary roller structure of the secondary gate member is located within a secondary plane that is perpendicular to a rotational axis of the second roller/rail structure, the first plane and the secondary plane being substantially coplanar with each other such that the second roller structure of the primary gate member and the secondary roller structure of the secondary gate member are configured to roll along a same linear rail.

7. The telescoping gate assembly of claim 1, further comprising:

a ground rail structure located underneath and in contact with the secondary roller.

8. The telescoping gate assembly of claim 7, wherein the secondary roller structure is directly connected to a bottom portion of the secondary gate member and in contact with the ground rail structure.

9. The telescoping gate assembly of claim 7, wherein the primary gate member and secondary gate member are configured to move from a first totally opened position to a second totally closed position, and wherein the secondary gate member is located in the cavity in the primary gate member and the primary gate member and secondary gate member are located on a first side of the frame when in the first totally opened position, and the secondary gate member extends from the cavity of the primary gate member and the primary gate member and the entire secondary gate member are located on a second side of the frame opposed to the first side of the frame when in the second totally closed position.

10. The telescoping gate assembly of claim 1, wherein the primary gate member includes a second side wall extending substantially parallel with the at least one side wall and forming a substantially rectangular tube like structure with the at least one side wall and the top wall and bottom wall of the primary gate member.

11. A telescoping gate assembly comprising:

a frame;

a ground roller/rail structure formed along at least one imaginary line;

a primary gate member connected to the frame such that the primary gate member is movable relative to the frame and is located above the ground roller/rail structure, the primary gate member including at least one side wall, a top wall, and a bottom wall forming a cavity therein, at least one primary ground roller/rail structure located at the bottom wall and extending downward and away from the cavity and in operative contact with the ground roller/rail structure at a first location;

a secondary gate member directly connected to the primary gate member such that the secondary gate member is movable relative to the primary gate member and the frame, and the secondary gate member includes at least one secondary ground roller/rail structure in operative contact with the ground roller rail structure at a second location, wherein the first location and second location are each located along the imaginary line;

a retraction cable connected to the primary gate member via a first pulley and connected to the secondary gate member via a second pulley;

an extension cable connected to the primary gate member and secondary gate member; and an actuator assembly configured to move at least one of the primary gate member and the secondary gate member relative to the frame.

12. The telescoping gate assembly of claim 11, further comprising wherein the actuator assembly includes:

a drive cable connected to at least one of the primary gate member and secondary gate member; and a motor connected to the frame and configured to move the drive cable relative to the frame.

13. The telescoping gate assembly of claim 11, wherein the primary gate member and secondary gate member are configured to move from a first totally opened position to a second totally closed position, and wherein the secondary gate member is totally enveloped within the cavity in the primary gate member and the primary gate member and secondary gate member are located on a first side of the frame when in the first totally opened position, and the secondary gate member extends from the cavity of the primary gate member and the primary gate member and the entire secondary gate member are located on a second side of the frame opposed to the first side of the frame when in the second totally closed position.

14. The telescoping gate assembly of claim 11, wherein the top wall of the primary gate member includes a primary top roller/rail structure and the secondary gate member includes a secondary top roller/rail structure that contacts the primary top roller/rail structure of the top wall of the primary gate member.

15. The telescoping gate assembly of claim 11, wherein the primary gate member includes a second side wall extending substantially parallel with the at least one side wall and forming a substantially rectangular tube like structure with the at least one side wall and the top wall and bottom wall of the primary gate member.

16. A method of operating a telescoping gate assembly to provide vehicular access to and block vehicular access from a particular area, comprising:

providing a frame connected to a ground substrate, a primary gate member connected to the frame in a manner such that the primary gate member can move relative to the frame, a secondary gate member directly and telescopingly connected to the primary gate member in a manner such that the secondary gate member can move relative to the primary gate member and the frame, a ground roller/rail structure located on the ground substrate, a retraction cable connected to the primary gate member via a first pulley and connected to the secondary gate member via a second pulley, an extension cable connected to the primary gate member and secondary gate member, wherein the primary gate member includes a primary lower roller/rail structure which cooperates with the ground roller/rail structure of the ground substrate, and wherein the secondary gate member includes a secondary lower roller/rail structure that cooperates with the ground roller/rail structure to allow the primary gate member to move with respect to the secondary gate member;

moving the secondary gate member with respect to the primary gate member from a fully opened position at which the primary gate member and secondary gate member are located on a first side of the frame to a fully closed position at which the secondary gate member extends from the primary gate member and the primary gate member and secondary gate member are located on an opposing side of the frame.

17. The method of operating a telescoping gate assembly of claim 16, wherein providing includes providing the frame in an outdoor area exposed to elements of nature.

18. The method of operating a telescoping gate assembly of claim 16, wherein providing includes providing a drive member connected to at least one of the primary gate member and secondary gate member, and providing a motor connected to the frame and configured to move the drive member relative to the frame, and moving includes driving the motor to move the drive member which in turn moves the primary gate member.

19. The method of operating a telescoping gate assembly of claim 16, wherein providing includes providing a primary upper roller/rail structure at an upper portion of the primary gate member and a secondary upper roller/rail structure at an upper portion of the secondary gate member, and moving includes rolling at least one of the primary upper roller/rail structure and the secondary upper roller/rail structure relative to the other of the primary upper roller/rail structure and the secondary upper roller/rail structure while simultaneously rolling at least one of the primary lower roller/rail structure and the secondary lower roller/rail structure relative to the ground roller/rail structure.

* * * * *